US009029060B2

(12) United States Patent
Tujihiro et al.

(10) Patent No.: US 9,029,060 B2
(45) Date of Patent: May 12, 2015

(54) CARRIER AND TWO-COMPONENT DEVELOPER

(71) Applicant: KYOCERA Document Solutions Inc., Osaka-shi (JP)

(72) Inventors: Masami Tujihiro, Osaka (JP); Yoshio Ozawa, Osaka (JP)

(73) Assignee: KYOCERA Document Solutions Inc., Osaka-Shi (JP)

( * ) Notice: Subject to any disclaimer, the term of this patent is extended or adjusted under 35 U.S.C. 154(b) by 0 days.

(21) Appl. No.: 14/037,248

(22) Filed: Sep. 25, 2013

(65) Prior Publication Data

US 2014/0087301 A1 Mar. 27, 2014

(30) Foreign Application Priority Data

Sep. 27, 2012 (JP) ..... 2012-214226

(51) Int. Cl.

| | |
|---|---|
| ***G03G 9/00*** | (2006.01) |
| ***G03G 9/113*** | (2006.01) |
| ***G03G 9/107*** | (2006.01) |

(52) U.S. Cl.

CPC ..... *G03G 9/1135* (2013.01); *G03G 9/107* (2013.01); *G03G 9/1075* (2013.01); *G03G 9/1132* (2013.01); *G03G 9/1137* (2013.01)

(58) Field of Classification Search

USPC ..... 430/111.1, 111.3, 111.32, 111.35

See application file for complete search history.

(56) References Cited

U.S. PATENT DOCUMENTS

| | | | | |
|---|---|---|---|---|
| 6,165,663 | A * | 12/2000 | Baba et al. | 430/111.3 |
| 2012/0115078 | A1 | 5/2012 | Kinoshita et al. | |

FOREIGN PATENT DOCUMENTS

| | | | |
|---|---|---|---|
| JP | H05-134463 | A | 5/1993 |
| JP | 2011-002497 | A | 1/2011 |

* cited by examiner

*Primary Examiner* — Thorl Chea

(74) *Attorney, Agent, or Firm* — Knobbe Martens Olson & Bear LLP

(57) ABSTRACT

A carrier for electrostatic latent image developing is composed of carrier core containing a binder resin and magnetic material particles, and a shell layer that covers the carrier core. The binder has an acid value of at least a predetermined value, and contains a resin having a carboxyl group. The shell layer is composed of a resin selected from melamine resin and urea resin.

4 Claims, 1 Drawing Sheet

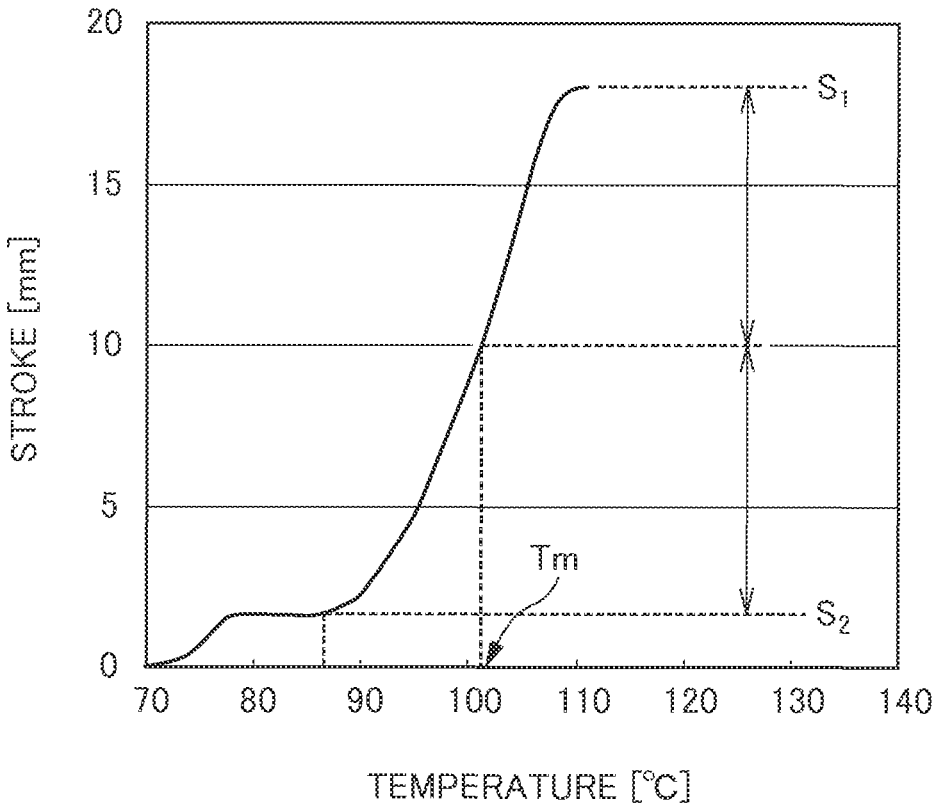
20
15
10
5
0
STROKE [mm]
70
80
90
100
110
120
130
140
TEMPERATURE [°C]
S1
S2
Tm

CARRIER AND TWO-COMPONENT DEVELOPER

INCORPORATION BY REFERENCE

This application is based upon and claims the benefit of priority from the corresponding Japanese Patent Application No. 2012-214226, filed in the Japan Patent Office on Sep. 27, 2012, the entire contents of which are incorporated herein by reference.

BACKGROUND

The present disclosure relates to a carrier and a two-component developer.

In general, in electrophotography, the surface of a photoconductor drum is charged by a method such as corona discharge, followed by exposure using a laser etc. to form an electrostatic latent image. The formed latent image is developed with a toner so as to from a toner image. The formed toner image is transferred onto a recording medium to obtain an image with high quality. The toner used for formation of a toner image is typically a toner including toner particles (toner base particles) with an average particle diameter of 5 μm or larger and 10 μm or smaller produced by mixing a binder resin such as thermoplastic resin with components such as a colorant, a charge control agent and a release agent, followed by a kneading step, a pulverization step and a classification step. For the purpose of providing flowability or suitable charging performance for the toner particles, and/or for facilitating cleaning of the toner particles from the surface of the photoconductor drum, silica and/or inorganic fine particles such as those of titanium oxide are externally added to the toner base particles.

As such a developing system using such a toner, a one-component developing system using the toner independently as a developer (one-component developer), and a two-component developing system using a developer formed by mixing toner and carrier (two-component developer) are known. Then, in the two-component developer system using a two-component developer, the carrier particles cause the toner particles to be charged by frictional electrification, as well as bearing the role of transporting toner particles. For this reason, there is an advantage in that the electrostatic property and transport property of the toner particles when beginning image formation tend to be comparatively stable.

Conventionally, as the carrier used in such a two-component developing system, a magnetic carrier composed of particles of a metal with large specific gravity like magnetite and ferrite have been used. However, when using such metallic particles as the carrier, the mechanical load acting on the stirring unit mixing the two-component developer inside a developing unit positioned in the image formation apparatus may become excessively large.

For this reason, in order to decrease the mechanical load acting on the stirring unit upon forming an image using a two-component developer, a magnetic dispersion-type resin carrier in which magnetic material fine particles are dispersed in a binder resin of low specific gravity has been proposed. The magnetic material dispersion-type resin carrier has a small specific gravity compared to a carrier composed of particles of metal; therefore, the load acting on the stirring unit upon forming an image using the two-component developer is mitigated. It is thereby possible to reduce the size of the motor driving the stirring unit when using a two-component developer containing a magnetic material dispersion-type resin carrier, and thus energy savings and a size reduction are achieved in the image formation apparatus based on a two-component developing system.

However, when repeatedly forming images using a two-component developer containing a magnetic material dispersion-type resin carrier, the magnetic material may drop out from the carrier particles from the repeated stress acting on the carrier particles. If the magnetic material drops out from the carrier particles, the ability of the carrier particles to charge the toner particles will decline, and oppositely charged toner particles may tend to generate, which leads to scattering of toner particles. For this reason, an improvement in the durability of the carrier has been desired.

Therefore, with the object of improving the durability of the carrier, a magnetic material dispersion-type resin carrier has been proposed that is composed of ferromagnetic iron oxide fine particles and cured phenol resin, and has a cover layer composed of melamine resin formed on the particle surface of magnetic material dispersion-type core particle.

However, for the above-mentioned magnetic material dispersion-type resin carrier, the phenol resin contained in the core particles and the melamine resin constituting the cover layer of the core particle surface generally have low affinity. For this reason, in the case of forming images for a long time using the two-component developer containing the proposed magnetic material dispersion-type resin carrier, separation of the coating resin will occur. Then, if separation of the coating resin occurs, there is a possibility of dropping out of the magnetic material occurring, similarly to the conventionally known magnetic material dispersion-type resin carrier. For this reason, further improvement in the durability of the carrier has been demanded.

SUMMARY

A carrier for electrostatic latent image developing according to one aspect of the present disclosure includes:

a carrier core containing at least a binder resin and magnetic material particles; and a shell layer that covers the carrier core, in which the binder resin contains a resin having a carboxyl group, the acid value of the binder resin is at least 10 mg KOH/g, and the shell layer contains a resin selected from the group consisting of melamine resin and urea resin.

A two-component developer according to another aspect of the present disclosure includes: toner; and the carrier for electrostatic latent image developing according to the one aspect.

BRIEF DESCRIPTION OF DRAWINGS

FIG. 1 is a view that illustrates a method of measuring a softening point using an elevated flow tester.

DETAILED DESCRIPTION

The present disclosure is explained in detail with respect to embodiments thereof below; however, the present disclosure is not limited at all to the embodiments and may be carried out with appropriately making a change within the purpose of the present disclosure. In addition, explanation may be occasionally omitted with respect to duplicated matters; this does not however limit the gist of the present disclosure.

First Embodiment

A carrier for electrostatic latent image developing according to a first embodiment of the present disclosure (hereinafter simply referred to as carrier) is composed of a carrier core containing binder resin and magnetic material particles, and a shell layer that covers the carrier core. Hereinafter, the carrier core and shell layer constituting the carrier and a method of producing the carrier will be explained.

Carrier Core

The carrier core essentially contains a binder resin and magnetic material particles. In addition, the carrier core may contain optional components other than the binder resin and magnetic material particles. Hereinafter, for the carrier core of the present disclosure, the binder resin and magnetic material particle, which are essential components, as well as optional components other than the binder resin and magnetic material particle, will be explained in order.

(Binder Resin)

The binder resin contains a resin having carboxyl groups, and the acid value thereof is at least 10 mg KOH/g. The shell layer is composed of a resin selected from melamine resin and urea resin. Then, an intermediate of the melamine resin or urea resin has a methylol group generated by formaldehyde adding to the melamine or urea. In the case of the carrier core and shell layer being composed of such materials, and forming the shell layer to cover the carrier core using a suitable method described later, covalent bonds are formed between the carrier core and shell layer through the reaction between the carboxyl group exposed at the surface of the carrier core and the methylol group possessed by the intermediate of the material of the shell layer. For this reason, in the carrier of the present disclosure, the shell layer firmly binds to the carrier core.

The type of binder resin contained in the carrier core is not particularly limited so long as being a resin used as a binder resin for magnetic material dispersion-type resin carriers conventionally, including resins having a carboxyl group, and the acid value being at least 10 mg KOH/g. As specific examples of the binder resin, resins having carboxyl groups can be exemplified such as an acrylic resin containing units derived from (meth)acrylic acid, a styrene acrylic resin containing units derived from (meth)acrylic acid, and a polyester resin. Among these resins, polyester resins are preferable from the aspects of ability of carrier particles to charge toner, dispersibility of magnetic material particles in the binder resin, and ease of adjustment of acid value of binder resin. Hereinafter, the polyester resin will be explained.

The acid value of the acrylic resin and styrene acrylic resin can be adjusted by adjusting the amount of (meth)acrylic acid in the monomer. The acid value of the polyester resin can be adjusted by adjusting the balance between the amount of hydroxyl groups possessed by the alcohol component and the amount of carboxyl groups possessed by the carboxylic acid component used in the synthesis of the polyester resin.

The polyester resin can employ one obtained by condensation polymerizing or condensation co-polymerizing a divalent, trivalent or higher alcohol component with a divalent, trivalent or higher carboxylic acid component. As the components used upon synthesizing the polyester resin, the following divalent, trivalent or higher alcohol components and divalent, trivalent or higher carboxylic acid components can be exemplified.

Specific examples of the divalent, trivalent or higher-valent alcohols may be exemplified by diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher-valent alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent, trivalent or higher-valent carboxylic acids include divalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylenecarboxyl)methane, 1,2,7,8-octanetetracarboxylic acid, pyromellitic acid, and Enpol trimer. These divalent, trivalent or higher-valent carboxylic acids may be used as ester-forming derivatives such as an acid halide, an acid anhydride, and a lower alkyl ester. Here, the term "lower alkyl" means an alkyl group of from 1 to 6 carbon atoms.

Although it is preferable to use a thermoplastic resin as the binder resin, it is possible to not only independently employ a thermoplastic resin, but also to add a crosslinker or a thermosetting resin to the thermoplastic resin. By introducing a partial crosslinked structure into the binder resin, it is possible to raise the durability of the carrier particle.

As a thermosetting resin that can be used along with the thermoplastic resin, epoxy resins and cyanate resins are preferred. As specific examples of suitable thermosetting resins, bisphenol A epoxy resin, hydrogenated bisphenol A epoxy resin, Novolak-type epoxy resins, polyalkylene ether epoxy resins, cyclic aliphatic epoxy resins, and cyanate resins can be exemplified. These thermosetting resins can be used by combining two or more types.

The acid value of the binder resin is preferably at least 10 mg KOH/g to no more than 30 mg KOH/g. By the acid value of the binder resin being at least 10 mg KOH/g, the carrier core and shell layer will be firmly bonded. In the case of using a binder resin having such an acid value, since an abundance of carboxyl groups will be exposed at the surface of the carrier core, a covalent bonds tend to be formed between the carrier core and shell layer through the reaction between the carboxyl group and the methylol group possessed by the intermediate of the material of the shell layer. By covalent bonds being formed between the carrier core and shell layer, the carrier core and shell layer will be firmly bonded, whereby it is possible to improve the durability of the carrier particle.

With the carrier core containing binder resin having an excessively low acid value, the amount of carboxyl groups exposed at the surface of the carrier core will become few. When the amount of carboxyl groups exposed at the surface of the carrier core is few, covalent bonds occurring, by reaction of the carboxyl group with the methylol group possessed by the intermediate of the material of the shell layer, will hardly be formed; therefore, the shell layer will tend to peel off from the carrier core surface.

The glass transition point (Tg) of the binder resin is preferably 60° C. or more and 80° C. or less, and more preferably 65° C. or more and 75° C. or less. In the case of producing carrier particles using carrier cores containing a binder resin having an excessively low Tg, it will be difficult to obtain carrier particles excelling in strength. In the case of producing carrier cores using a binder resin having an excessively high Tg, upon pulverizing the kneading product of the binder resin and magnetic material particles by the production method of the carrier cores described later, it may be difficult to prepare carrier cores of a desired particle size. The glass transition point of the binder resin can be measured according to the following method.

Glass Transition Point Measurement Method

The glass transition point of the binder resin can be obtained from the turning point of the specific heat of the binder resin, using a differential scanning calorimeter (DSC). More specifically, it can be obtained by measuring the endothermic curve of the binder resin using, as measurement equipment, a differential scanning calorimeter DSC-6200, manufactured by Seiko Instruments Inc. Ten milligrams of a measurement sample is placed inside of an aluminum pan, the empty aluminum pan is used as a reference, and the glass transition point can be obtained from the endothermic curve obtained by measuring under room temperature and normal humidity at a heating rate of 10° C./min in the measurement temperature range of 25° C. or more and 200° C. or less.

The melting point (Tm) of the binder resin is preferably 130° C. or more and 160° C. or less, and more preferably 135° C. or more and 155° C. or less. By using carrier core containing binder resin having such a melting point, carrier particles excelling in durability can be obtained. In addition, in the case of using a binder resin having such a melting point, upon pulverizing the kneading product of the binder resin and magnetic material particles with the production method of carrier cores described later, it is easy to adjust the particle size of the carrier cores to a desired range. The melting point of the binder resin can be measured according to the following method.

Melting Point Measurement Method

Measurement of the melting point (Tm) is performed using an elevated flow tester (CFT-500D manufactured by Shimadzu Corp.). The melting point (Tm) is measured by setting the measurement sample in the elevated flow tester, and allowing a 1 $cm^3$ sample to melt and flow out at conditions of a dice pore size of 1 mm, plunger load of 20 $kg/cm^2$, and heating rate of 6° C./min. From an S-shaped curve relating to the temperature (° C.)/stroke (mm) obtained by the measurement of the elevated flow tester, the melting point (Tm) is read.

How the melting point (Tm) is read is explained with reference to FIG. 1. The maximum stroke value is defined as $S_1$, and the baseline stroke value on the lower temperature side is defined as $S_2$. The temperature at which the stroke value is $(S_1+S_2)/2$ on the S-shaped curve is defined as the softening point of the measurement sample.

(Magnetic Material Particle)

As the magnetic material particle, particles conventionally used in carriers for two-component developers can be employed. As specific examples of the magnetic material particle, particles of materials such as iron, oxidized iron, reduced iron, magnetite, copper, silicon steel, ferrite, nickel and cobalt; particles of alloys of these materials and a metal such as manganese, zinc and aluminum; particles of alloys such as iron-nickel alloys and iron-cobalt alloys; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate and lithium niobate; and particles of high-dielectric constant substances such as ammonium dihydrogen phosphate, potassium dihydrogenphosphate and Rochelle salt can be exemplified. Among these, magnetite is preferable as the magnetic material particle.

The average particle size of the magnetic material particles is preferably 0.1 μm or more and 0.3 μm or less, and more preferably 0.15 μm or more and 0.25 μm or less. When using magnetic material particles having such an average particle size, the magnetic material particles tend to be uniformly dispersed in the binder resin, and dropping out of the magnetic material particles from the binder resin tends to be suppressed.

The volume resistivity of the magnetic material particles is preferably $1.0\times10^2$ Ωcm or more and $1.0\times10^7$ Ωcm or less, and more preferably $1.0\times10^4$ Ωcm or more and $1.0\times10^6$ Ωcm or less. The volume resistivity of the magnetic material particles can be measured using a dielectric loss measuring instrument (for example, TRS-10 model manufactured by Ando Electric Co., Ltd.). A disk-shaped measurement sample with a diameter of 5 cm and thickness of 2 mm, obtained by compressing 10 g of magnetic material particles at conditions of 100 $kg/cm^2$ of pressure for 1 minute using a commercial tablet molding machine, was used in the measurement of the volume resistivity. Using the obtained measurement sample, the volume resistivity is measured at conditions of a temperature of 30° C. and frequency of 1 kHz.

The saturated magnetization of the magnetic material particles is preferably 30 emu/g or more and 90 emu/g or less, and more preferably 40 emu/g or more and 80 emu/g or less. The saturated magnetization of the magnetic material particles can be measured using a vibrating sample magnetometer (for example, VSM-P7 manufactured by Toei Industry Co., Ltd.) at conditions of applied magnetic field of 5 kOe (397.8 kA/m), and excitation frequency of 80 Hz.

(Components Other than Binder Resin and Magnetic Material Particle)

As an optional component other than the binder resin and magnetic material particles, the carrier cores may contain a conductive material like carbon black with the object of adjusting the electrical conductance of the carrier. As the carbon black, acetylene black is preferred. By producing carrier particles using carrier cores containing a small amount of acetylene black, it is possible to decrease the volume resistivity of the carrier particles. In the case of containing carbon black in the carrier core as the conductive material, the content of the carbon black is preferably 20% by mass or less, and more preferably 10% by mass or less, relative to the mass of carrier core. The volume average particle size of the carbon black is preferably 10 nm or more and 100 nm or less, and more preferably 50 nm or more and 60 nm or less.

Shell Layer

In the carrier of the present disclosure, the surface of the carrier core is covered with a shell layer. The binder resin contained in the carrier core includes a resin having carboxyl groups. The shell layer is composed of a resin selected from melamine resin and urea resin. By the carrier core and shell layer being composed of such materials, and forming the shell layer to cover the carrier core using a suitable method described later, the shell layer firmly binding to the carrier core is formed.

A polycondensation product of melamine and formaldehyde can be exemplified as the melamine resin, and a polycondensation product of urea and formaldehyde can be exemplified as the urea resin. In the production method of melamine resin, first, melamine and formaldehyde are made to undergo addition reaction to obtain a precursor of the melamine resin (methylolated melamine). Next, melamine resin is obtained though condensation of methylolated melamines, i.e. crosslinking reaction of melamine in which the amino groups possessed by melamine are mutually bound via a methylene group. The urea resin is obtained using a similar production method to the melamine resin, except for using urea instead of melamine.

The mass of shell layer is preferably 0.5 parts by mass or more and 20 parts by mass or less, and more preferably 0.7 parts by mass or more and 15 parts by mass or less, relative to 100 parts by mass of the carrier core.

Production Method of Carrier

Hereinafter, the production method of the carrier core and formation method of the shell layer related to a suitable production method of the carrier according to the first embodiment will be explained in order.

(Production Method of Carrier Core)

The production method of the carrier core is not particularly limited and can be appropriately selected from known methods, so long able to favorably disperse the magnetic material particles in the binder resin.

As a suitable production method of the carrier core, a method, in which binder resin and the magnetic material particles, which are essential components of the carrier core, are mixed, using a mixer, followed by melt kneading the obtained mixture, and pulverizing and classifying the obtained kneaded product, can be exemplified. The melt kneading equipment used in the production of carrier core is not particularly limited, and can be appropriately selected from equipment used in the melt kneading of thermoplastic resins. A single screw or twin screw extruder can be exemplified as a specific example of melt kneading equipment.

(Formation Method of Shell Layer)

The method of forming the shell layer that covers the carrier core is not particularly limited so long as the carrier coat is favorably covered with a resin selected from melamine resin and urea resin. The coating of the carrier core by the shell layer is preferably carried out in a solvent that can dissolve melamine, urea or a precursor (methylolated product) generated from the addition reaction between these and formaldehyde, like water, methanol or ethanol.

In the case of forming the shell layer in a solvent like water, methanol or ethanol, in order to uniformly coat the surface of the carrier core with the shell layer, it is preferable to cause the carrier cores to disperse in the solvent used in the formation of the shell layer. The method for dispersing the carrier cores in the solvent used in the formation of the shell layer is not particularly limited so long as able to cause the carrier cores to disperse to a high degree in the solvent used in the formation of the shell layer. Upon obtaining a dispersion liquid of the carrier cores, since the carrier cores tend to be caused to disperse to a high degree in the solvent used in the formation of the shell layer, it is preferable to use equipment that can powerfully stir the dispersion liquid such as a HIVIS MIX (manufactured by PRIMIX Corp.).

A dispersant for dispersing the carrier cores can be contained in the solvent used in the formation of the shell layer. In the case of containing dispersant in the solvent used in the formation of the shell layer, the carrier cores can be made to stably disperse in the solvent used in the formation of the shell layer.

As the dispersant, it is possible to use sodium polyacrylate, polyparavinylphenol, partially saponified polyvinyl acetate, isoprene sulfonic acid, polyether, isobutylene/maleic anhydride copolymer, sodium polyaspartic acid, starch, gelatin, gum Arabic, polyvinyl pyrrolidone and sodium lignin sulfonic acid. These dispersants may be used individually, or by combining two or more types.

The amount of dispersant used is preferably 5 parts by mass or mare and 50 parts by mass or less relative to 100 parts by mass of carrier cores.

As described above, in the case of causing the carrier cores to disperse using a dispersant upon forming the shell layer, since the carrier cores are dispersed to a high degree in the solvent used in the formation of the shell layer, the carrier cores tend to be uniformly coated with the shell layer. On the other hand, if the carrier cores are made to disperse using dispersant, since the dispersant will adhere to the surface of the carrier cores, the shell layers will be formed in a state in which the dispersant is present at the interfaces between the carrier cores and the shell layers. When this is done, the formation of covalent bonds between the shell layers and carrier cores is inhibited by the influence of the dispersant present at the interfaces between the shell layers and carrier cores, depending on the amount of dispersant adhering to the surface of the carrier cores, and the adhesion of the shell layers to the carrier cores may worsen. If the adhesion of the shell layer to the carrier core worsens, the shell layers will tend to peel off from the carrier cores from the mechanical stress acting on the carrier.

For this reason, in the case of causing the carrier core to disperse in the solvent used in the formation of the shell layer by using dispersant, it is preferable to remove the dispersant eluted in the solvent phase from the surface of the carrier cores prior to forming the shell layer. In the case of re-dispersing the carrier cores adsorbing dispersant in the solvent, the dispersant adsorbed to the surfaces of the carrier cores will partly elute in the solvent. In this case, the dispersant still adsorbed to the carrier cores contributes to an improvement in the wettability of the surfaces of the carrier cores to the solvent. In contrast, the dispersant eluted in the solvent is not preferable because it promotes the generation of single polymer particles of melamine resin or urea resin in the solvent. For this reason, it is preferable to remove at least part of the dispersant adhering to the surface of the carrier cores. As a suitable method to remove at least part of the dispersant adhering to the surface of the carrier core, a method of washing the carrier cores to which surface dispersant adheres using a solvent that can be used in the formation of the shell layer can be exemplified. Washing of the carrier cores is preferably performed at conditions such that the carrier cores do not dry, in order to prevent aggregation of the carrier cores. The number of times washing upon removing the dispersant adhering to the carrier cores is not particularly limited so long as able to favorably disperse the carrier cores in the dispersant.

After dissolving the materials for forming the shell layer in the dispersion liquid of the carrier cores, the materials for forming the shell layer are allowed to react in the dispersion liquid to form the shell layer that covers the surfaces of the carrier cores. As the materials for forming the shell layer, melamine and formaldehyde, urea and formaldehyde, and precursors generated in the addition reaction between melamine and formaldehyde (methylolated product), and precursor generated in the addition reaction between urea and formaldehyde (methylolated product) can be exemplified.

It should be noted that the pH of the dispersion liquid dispersing the carrier cores in the solvent used in the formation of the shell layer is preferably adjusted to 2 or more and 6 or less using an acidic substance prior to formation of the shell layer. By adjusting the pH of the dispersant to the acidic side, it is possible to promote the formation of the shell layer.

The temperature upon forming the shell layer composed of melamine resin or urea resin is preferably 60° C. or more and 70° C. or less. By forming the shell layer under a temperature in such a range, the formation of the shell layer covering the surfaces of the carrier cores favorably progresses. In addition, by forming the shell layer under a temperature in such a range, the carboxyl groups exposed at the surface of the carrier cores and the methylol groups contained in the materials for forming the shell layer react, and covalent bonds between the carrier cores and shell layer tend to be formed. By the carrier cores and shell layer covalently bonding, it is possible to cause the shell layer to firmly adhere to the carrier cores.

After the methylolated product of melamine or urea has completely reacted in the dispersion liquid under heating, it is possible to obtain the dispersion liquid containing carrier particles by cooling the dispersion liquid down to room temperature. Subsequently, the carrier particles are recovered from the dispersion liquid containing the carrier particles, as required, through at least one process selected from a washing process of washing the carrier particles, and a drying process of drying the carrier particles. Hereinafter, the washing process and drying process will be explained.

(Washing Process)

The carrier particles are washed using water, as necessary. As the washing method, a method that performs solid-liquid separation on the dispersion liquid containing carrier particles, recovers the carrier particles as wet cake and washes the obtained wet cake using water, or a method that causes the carrier particles in the dispersion liquid containing carrier particles to precipitate, substitutes the supernatant fluid with water, and after substitution, causes the carrier particles to re-disperse in water can be exemplified.

(Drying Process)

The carrier particles may be dried as necessary. The method of drying the carrier particles is not particularly limited. As a suitable drying method, a method using a dryer such as a spray dryer, fluidized bed dryer, vacuum freeze dryer, and vacuum dryer can be exemplified.

The carrier for electrostatic latent image developing of the present disclosure explained above can reduce the load acting on the stirring unit inside of the developing unit equipped to an image formation apparatus, and in the case of using along with toner as a two-component developer, can suppress the generation of toner scatter caused by a decline in the ability of the carrier to charge the toner and the generation of oppositely charged toner particles, upon performing image formation over an extended time period. For this reason, the carrier for electrostatic latent image developing of the present disclosure is suitably blended into a two-component developer used in various image formation apparatuses.

Second Embodiment

A two-component developer according to the second embodiment of the present disclosure contains toner and the carrier for electrostatic latent image developing according to the first embodiment. Hereinafter, the toner and the preparation method of the two-component developer will be explained.

Toner

In the toner particles contained by the toner included in the two-component developer according to the second embodiment of the present disclosure, components such as colorant, a charge control agent and a release agent are blended into the binder resin as necessary. The toner particles may have an external additive adhered to the surface thereof. The toner may be composed of only toner particles, or may be composed of toner particles and components other than the toner particles. Hereinafter, the binder resin, colorant, charge control agent, release agent, external additive and production method of toner will be explained in order.

(Binder Resin)

The binder resin contained in the toner particles is not particularly limited so long as being a resin conventionally used as a binder resin for toner. As specific examples of the binder resin, thermoplastic resins such as styrene resins, acrylic resins, styrene-acrylic resins, polyethylene resins, polypropylene resins, vinyl chloride resins, polyester resins, polyamide resins, polyurethane resins, polyvinyl alcohol resins, vinyl ether resins, N-vinyl resins and styrene-butadiene resins can be exemplified. Among these resins, styrene-acrylic resins and polyester resins are preferable from the aspects of dispersibility of colorants in the toner, chargeability of the toner, and fixability to paper. Hereinafter, the styrene-acrylic resins and polyester resins will be explained.

The styrene-acrylic resin is a copolymer of styrene monomer and acrylic monomer. As specific examples of the styrene monomer, styrene, α-methylstyrene, vinyl toluene, α-chlorostyrene, o-chlorostyrene, m-chlorostyrene, p-chlorostyrene, and p-ethylstyrene can be exemplified. As specific examples of the acrylic monomer, (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate can be exemplified.

As the polyester resin, one obtained by condensation polymerizing or condensation copolymerizing an alcohol component and carboxylic acid component can be used. As the component used upon synthesizing the polyester resin, the following bivalent, trivalent or higher-valent alcohol components and bivalent, trivalent or higher-valent carboxylic acid components can be exemplified.

The bivalent, trivalent or higher-valent alcohol components and bivalent, trivalent or higher-valent carboxylic acid components used in the synthesis of the polyester resin that is the binder resin for the toner are the same as the bivalent, trivalent or higher-valent alcohol components and bivalent, trivalent or higher-valent carboxylic acid components used in the synthesis of the polyester resin used as the binder resin in the preparation of the aforementioned carrier cores.

In the case of the binder resin being a polyester resin, the softening point of the polyester resin is preferably 80° C. or more and 150° C. or less, and more preferably 90° C. or more 140° C. or less.

As the binder resin, although it is preferable to use a thermoplastic resin due to the fixability of the toner to paper being favorable, it is possible to not only use a thermoplastic resin alone, but also to add crosslinker or a thermosetting resin to the thermoplastic resin. By introducing a partial cross-linked structure into the binder resin, properties of the toner such as the storage stability, morphological retention and durability can be improved without degrading the fixability of the toner to paper.

As the thermosetting resin that can be used together with the thermoplastic resin, epoxy resins and cyanate resins are preferable. As specific examples of suitable thermosetting resins, bisphenol-A type epoxy resins, hydrogenated bisphenol-A type epoxy resins, novolak-type epoxy resins, polyalkylene ether-type epoxy resins, cyclic aliphatic-type epoxy resins and cyanate resins can be exemplified. These thermosetting resins can be used by combining two or more types.

The glass transition point (Tg) of the binder resin is preferably 50° C. or more and 65° C. or less, and more preferably 50° C. or more and 60° C. or less. In the case of the glass transition point of the binder resin being excessively low, toner particles may fuse together inside of the developing unit of the image formation apparatus, and the toner particles may partially fuse together during transport of a toner container or during storage of a toner container in a warehouse or the like, caused by a decline in the storage stability. In addition, in the case of the glass transition point being excessively high, the strength of the binder resin will decline, and the toner will tend to adhere to the latent image bearing unit (image carrier: photoreceptor). In the case of the glass transition point being excessively high, it will tend to be difficult for the toner to favorably fix at low temperature.

The glass transition point of the binder resin of the toner can be measured by the same method as the glass transition point of the binder resin used in the preparation of the aforementioned carrier cores.

(Colorant)

The toner particles may contain colorant in the binder resin. The colorant contained in the binder resin can employ known pigments or dyes in accordance with the color of the toner particles. As specific examples of suitable colorants that can be contained in the binder resin, the following colorants can be exemplified.

As a black colorant, carbon black can be exemplified. As the black colorant, a colorant colored to black using colorants such as the yellow colorants, magenta colorants and cyan colorants described later can also be utilized.

In the case of the toner being color toner, colorants such as yellow colorant, magenta colorant and cyan colorant can be exemplified as the colorants blended in the binder resin.

Examples of the yellow colorant include colorants such as those of condensed azo compounds, isoindolinone compounds, anthraquinone compounds, azo metal complexes, methine compounds and arylamide compounds. Specific examples of the yellow colorant include C.I. pigment yellows 3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191 and 194; Naphthol Yellow S, Hansa Yellow G, and C.I. Vat Yellow.

Examples of the magenta colorant include those of condensed azo compounds, diketo-pyrrolo-pyrrole compounds, anthraquinone compounds, quinacridone compounds, basic dye lake compounds, naphthol compounds, benzimidazolone compounds, thioindigo compounds and perylene compounds. Specific examples of the magenta colorant include C.I. pigment reds 2, 3, 5, 6, 7, 19, 23, 48:2, 48:3, 48:4, 57:1, 81:1, 122, 144, 146, 150, 166, 169, 177, 184, 185, 202, 206, 220, 221 and 254.

Examples of the cyan colorant include those of copper phthalocyanine compounds, copper phthalocyanine derivatives, anthraquinone compounds and basic dye lake compounds. Specific examples of the cyan colorant include C.I. pigment blues 1, 7, 15, 15:1, 15:2, 15:3, 15:4, 60, 62 and 66; Phthalocyanine Blue, C.I. Vat Blue, and C.I. Acid Blue.

The amount of colorant blended into the binder resin is preferably 1 part by mass or more and 20 parts by mass or less, and more preferably 3 parts by mass or more 10 parts by mass or less, relative to 100 parts by mass of binder resin.

(Charge Control Agent)

The toner particles may contain a charge control agent. The charge control agent is used for the purpose of improving a charge level stability of the toner particles or a charge-increasing property, which gives an indication of chargeability of toner particles to a predetermined charge level within a short time, to thereby obtain toner particles with excellent durability and stability. When developing by positively charging the toner particles, a positively chargeable charge control agent is used. When developing by negatively charging the toner particles, a negatively chargeable charge control agent is used.

The charge control agent may be appropriately selected from those used for toners heretofore. Specific examples of the positively chargeable charge control agent may be exemplified by azine compounds such as pyridazine, pyrimidine, pyrazine, ortho-oxazine, meta-oxazine, para-oxazine, ortho-thazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes consisting of azine compounds such as azine Fastred FC, azine Fastred 12BK, azine Violet BO, azine Brown 3G, azine Light Brown GR, azine Dark Green BH/C, azine Deep Black EW, and azine Deep Black 3RL; nigrosine compounds such as nigrosine, nigrosine salts, and nigrosine derivatives; acid dyes consisting of nigrosine compounds such as nigrosine BK, nigrosine NB, and nigrosine Z; metal salts of naphthenic acid or higher fatty acid; alkoxylated amines; alkylamides; quaternary ammonium salts such as benzylmethylhexyldecyl ammonium and decyltrimethylammonium chloride. These positively chargeable charge control agents may be used in a combination of two or more.

In addition, resins having a quaternary ammonium salt, a carboxylic acid salt, or a carboxyl group as a functional group may be used as the positively chargeable charge control agent. More specifically, styrene resins having a quaternary ammonium salt, acrylic resins having a quaternary ammonium salt, styrene-acrylic resins having a quaternary ammonium salt, polyester resins having a quaternary ammonium salt, styrene resins having a carboxylic acid salt, acrylic resins having a carboxylic acid salt, styrene-acrylic resins having a carboxylic acid salt, polyester resins having a carboxylic acid salt, styrene resins having a carboxylic group, acrylic resins having a carboxylic group, styrene-acrylic resins having a carboxylic group, and polyester resins having a carboxylic group, may be exemplified. These resins may be oligomers or polymers.

Among resins that may be used as the positively chargeable charge control agent, styrene-acrylic resins having a quaternary ammonium salt as a functional group are preferable because the charge amount can be easily adjusted to fall within the desired range. Specific examples of the preferable acrylic comonomer copolymerized with styrene monomer in preparation of a styrene-acrylic resin having a quaternary ammonium salt as a functional group include (meth)acrylic acid alkyl esters such as methyl acrylate, ethyl acrylate, n-propyl acrylate, isopropyl acrylate, n-butyl acrylate, isobutyl acrylate, 2-ethylhexyl acrylate, methyl methacrylate, ethyl methacrylate, n-butyl methacrylate and isobutyl methacrylate.

A unit derived through a process of quaternization from dialkylaminoalkyl (meth)acrylate, dialkyl (meth)acrylamide or dialkylaminoalkyl (meth)acrylamide is used as the quaternary ammonium salt. Specific examples of dialkylaminoalkyl (meth)acrylate include dimethylaminoethyl (meth)acrylate, diethylaminoethyl (meth)acrylate, dipropylaminoethyl (meth)acrylate and dibutylaminoethyl (meth)acrylate. Specific examples of dialkyl (meth)acrylamide include dimethyl (meth)acrylamide. Specific examples of dialkylaminoalkyl (meth)acrylamide include dimethylaminopropyl methacrylamide. In addition, hydroxyl group-containing polymerizable monomers such as hydroxyethyl (meth)acrylate, hydroxypropyl (meth)acrylate, 2-hydroxybutyl (meth)acrylate and N-methylol (meth)acrylate may be used in combination at a polymerization.

Specific examples of the negatively chargeable charge control agent may be exemplified by organic metal complexes and chelate compounds. The organic metal complex and the chelate compound are preferably acetylacetone metal complexes such as aluminum acetylacetonate and iron (II) acetylacetonate and salicylic acid metal complexes or salicylic acid metal salts such as 3,5-di-tert-butylsalicylic acid chromium and more preferably salicylic acid metal complexes or salicylic acid metal salts. These negatively chargeable charge control agents may be used in a combination of two or more.

Typically, the amount of positively charged or negatively charged charge control agent used is preferably 0.5 parts by mass or more and 20.0 parts by mass or less, and more preferably 1.0 part by mass or more and 15.0 parts by mass or less, when setting the total amount of toner as 100 parts by mass. In the case of forming an image using toner containing toner particles having excessively small amount of charge control agent, since it will be difficult to stably charge the toner particles to a predetermined polarity, the image density of the formed image may fall below a desired value, and it may be difficult to maintain the image density over an extended time. In addition, in this case, it will be difficult to uniformly disperse the charge control agent in the binder resin. In the case of forming an image using a toner containing toner particles containing non-uniformly dispersed charge control agent, fogging will tend to occur in the formed image, and contamination of the latent image bearing member tends to occur. In the case of forming an image using toner containing toner particles having excessively large amount of charge control agent, along with deterioration of the environmental resistance of the toner particles, image defects in the formed image caused by charge defects at high temperature and high humidity, and contamination of the latent image bearing member will tend to occur.

(Release Agent)

The toner particles may contain release agent as necessary. The release agent is typically used with the object of improving the fixability of toner and offset resistance. The type of release agent is not particularly limited so long as being one conventionally used as a release agent for toner.

Preferable release agents may be exemplified by aliphatic hydrocarbon waxes such as low molecular mass polyethylene, low molecular mass polypropylene, polyolefin copolymer, polyolefin wax, microcrystalline wax, paraffin wax, and Fischer-Tropsch wax; oxides of aliphatic hydrocarbon wax such as oxidized polyethylene wax and block copolymer of oxidized polyethylene wax; vegetable waxes such as candelilla wax, carnauba wax, Japan wax, jojoba wax, and rice wax; animal waxes such as bees wax, lanolin, and whale wax; mineral waxes such as ozokerite, ceresin, and petrolatum; waxes containing a fatty acid ester as a main component such as montanate ester wax and castor wax; and waxes obtained by deoxidization of a part or whole of fatty acid ester such as deoxidized carnauba wax.

Further, examples of the release agent that is suitably used include saturated straight-chain fatty acids such as palmitic acid, stearic acid, montanoic acid, and long-chain alkyl carboxylic acids having an alkyl group with a longer chain; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol, and long-chain alkyl alcohols having an alkyl group with a longer chain; polyhydric alcohols such as sorbitol; fatty acid amides such as linoleic acid amide, oleic acid amide and lauric acid amide; saturated fatty acid bisamides such as methylene bisstearic acid amide, ethylene biscapric acid amide, ethylene bislauric acid amide and hexamethylene bisstearic acid amide; unsaturated fatty acid amides such as ethylene bisoleic acid amide, hexamethylene bisoleic acid amide, N,N'-dioleyladipic acid amide and N,N'-dioleoyl sebacic acid amide and aromatic bisamides such as m-xylene bisstearic acid amide and N,N'-distearylisophthalic acid amide; fatty acid metal salts such as calcium stearate, calcium laurate, zinc stearate and magnesium stearate; waxes obtained by grafting a vinyl monomer such as styrene or acrylic acid to an aliphatic hydrocarbon wax; partially esterified products of a fatty acid and a polyhydric alcohol, such as behenic acid monoglyceride; and methyl ester compounds having a hydroxyl group, which are obtained by hydrogenating a vegetable fat and oil.

The amount of release agent used is preferably 1 part by mass or more and 30 parts by mass or less, relative to 100 parts by mass of binder resin. In the case of the toner particles being produced by the pulverizing method described later, the amount of release agent used is more preferably 1 part by mass or more and 8 parts by mass or less, and particularly preferably 2 parts by mass or more and 5 parts by mass or less, relative to 100 parts by mass of binder resin. In the case of forming an image using toner containing toner particles having excessively small amount of release agent, the desired effect regarding the suppression of offset and image smearing in the formed image may not be obtained. In the toner containing toner particles having excessively large amount of release agent, the toner particles tend to fuse together, and the storage stability may be low.

(External Additive)

On the toner particles contained in the toner, an external additive may be adhered to the surface thereof as necessary. It should be noted that a particle prior to being treated using the external additive may be described as a toner base particle in the specification of the present application and claims.

The external additive may be appropriately selected from external additives used for toners heretofore. Specific examples of the preferred external additive include silica and metal oxides such as alumina, titanium oxide, magnesium oxide, zinc oxide, strontium titanate and barium titanate. These external additives may be used in a combination of two or more. These external additives may be hydrophobized by using a hydrophobing agent such as an aminosilane coupling agent or silicone oil. When a hydrophobized external additive is used, reduction of the charge of the toner at high temperature and high humidity is easily suppressed, and a toner with excellent flowability is easily obtained.

Typically, the particle diameter of the external additive is preferably 0.01 μm or larger and 1.0 μm or smaller.

Typically, the amount of external additive used is preferably 1 part by mass or more and 10 parts by mass or less, and more preferably 2 parts by mass or more and 5 parts by mass or less, relative to 100 parts by mass of the toner base particles.

Production Method of Toner

The production method of the toner contained in the two-component developer according to the second embodiment of the present disclosure is not particularly limited so long as able to produce a toner containing toner particles containing the above explained components, as necessary, in the binder resin. The pulverizing method and coagulation method can be exemplified as suitable methods. In the pulverizing method, toner particles (toner base particles) are obtained by mixing the binder resin and optional components such as colorant, charge control agent and release agent, the obtained mixture being melt kneaded by melt kneading equipment such as a single screw or twin screw extruder, and the obtained melt kneading product being pulverized and classified. In the coagulation method, toner particles (toner base particles) are obtained by causing fine particles of components contained in the toner such as the binder resin, release agent and colorant to coagulate in an aqueous medium to obtain agglomerated particles, followed by heating the agglomerated particles to cause unification of the components contained in the agglomerated particles. The average particle size of toner particles obtained by employing the above-mentioned method is preferably 5 μm or more and 10 μm or less, in general.

The toner base particles obtained in this way may have the surface thereof treated using an external additive, as necessary. The treatment method of toner base particles using the external additive is not particularly limited, and can be appropriately selected from conventionally known treatment methods using external additives. More specifically, treatment using an external additive is carried out by adjusting the treatment conditions so that the particles of the external additive is not being embedded in the toner base particles, using a mixer such as a HENSCHEL MIXER or NAUTA MIXER.

(Production Method of Two-Component Developer)

The production method of the two-component developer is not particularly limited so long as being able to uniformly mix the toner and the carrier according to the first embodiment of the present disclosure. As a suitable method, a method for mixing the toner and carrier using mixing equipment such as a ball mill can be exemplified. The content of toner in the two-component developer is preferably 1% by mass or more and 20% by mass or less, and more preferably 3% by mass or more and 15% by mass or less, relative to the mass of the two-component developer.

EXAMPLES

The present disclosure is explained more specifically with reference to examples below. In addition, the present disclosure is not limited to the examples.

Preparation Example 1

Preparation of Magnetic Material Particles

As the magnetic material particles, magnetite particles surface treated using a silane coupling agent were prepared.

Under a dry atmosphere, 100 g of untreated magnetite particles (BL-220 manufactured by Titan Kogyo, Ltd.) were placed in a HENSCHEL MIXER (FM-10B manufactured by Mitsui Miike Machinery Co.) and stirred. Next, a surface treatment liquid was prepared in which 0.5 g of the silane coupling agent (3-methacryloxypropyl methyldimethoxysilane, KBM-502 manufactured by Shin-Etsu Chemical Co., Ltd.) was dissolved in 10 g of toluene (special grade, manufactured by Wako Pure Chemical Industries, Ltd.). The obtained surface treatment liquid was uniformly spray atomized onto the stirred magnetite particles. Subsequently, the magnetite particles wetted by the surface treatment liquid were reduced-pressure dried at room temperature, and magnetite particles surface treated using the silane coupling agent were obtained. The obtained surface treated magnetite particles had a volume average particle size ($D_{50}$) of 0.5 μm, volumetric resistivity of $5\times10^5$ Ωcm, and saturated magnetization of 70 emu/g. The volume average particle size ($D_{50}$) was calculated by capturing a TEM image of at least 100 magnetic material particles at 100,000 times magnification using a transmission electron microscope (JSM-7600 TEM manufactured by JEOL Ltd.), then measuring the projected area diameter for 100 arbitrarily selected magnetic material particles in the obtained TEM image using image analysis software (WINROOF by Mitani Co.), and taking the average value thereof. The volume resistivity was measured using a dielectric loss measuring instrument (TRS-10 model manufactured by Ando Electric Co., Ltd.). A disk-shaped measurement sample with a diameter of 5 cm and thickness of 2 mm obtained by compressing 10 g of magnetic material particles at conditions of 100 kg/cm$^2$ of pressure for 1 minute using a commercial tablet molding machine was used in the measurement of the volume resistivity. Using the obtained measurement sample, the volume resistivity was measured at conditions of a temperature of 30° C. and frequency of 1 kHz. The saturated magnetization was measured using a vibrating sample magnetometer (VSM-P7 manufactured by Toei Industry Co., Ltd.) at conditions of applied magnetic field of 5 kOe (397.9 kA/m), and excitation frequency of 80 Hz.

Preparation Example 2

Preparation of Carrier Cores A to E

Carrier cores A to D were prepared using polyester resin or styrene-acrylic resin as the binder resin.

With a HENSCHEL MIXER (FM-10B manufactured by Mitsui Miike Machinery Co.), 15 g of a resin having the acid value, glass transition point (Tg) and melting point (Tm) listed in Table 1 and 85 g of the magnetic material particles prepared in Preparation Example 1 were mixed. The obtained mixture was melt kneaded at conditions of a material charge rate of 5 kg/h, screw revolution speed of 160 rpm and set temperature range of 180° C. using a twin screw extruder (PCM-30 manufactured by Ikegai Corp.). After cooling the obtained melt kneaded product, the melt kneaded product was pulverized by a mechanical pulverizer (Turbo Mill T250 model manufactured by Matsubo Corp.). The carrier cores A to D were obtained by sieving the obtained pulverized articles with a 100 μm mesh sieve and 30 μm mesh sieve, and thereby removing coarse grains exceeding 100 μm in particle size and fine grains no more than 30 μm in particle size.

Carrier cores E were obtained by sieving Zn—Cu ferrite carrier (uncoated carrier core of carrier for TASKalfa5550 manufactured by Kyocera Document Solutions Inc.) with a sieve of 100 μm mesh and a sieve of 30 μm mesh, and thereby removing the coarse grains exceeding 100 μm in particle size and fine grains no more than 30 μm in particle size.

TABLE 1

| Carrier core | A | B | C | D |
|---|---|---|---|---|
| Binder resin | | | | |
| Type of resin | Polyester resin | Polyester resin | Copolymer of styrene, acrylic acid and butyl acrylate | Polyester resin |
| Acid value [mgKOH/g] | 20 | 12 | 23 | 8 |
| Tg [° C.] | 70 | 69 | 70 | 68 |
| Tm [° C.] | 150 | 145 | 148 | 140 |
| Amount used [g] | 15 | 15 | 15 | 15 |

Examples 1 to 9, and Comparative Examples 1 and 2

Dispersing Process

An aqueous solution of dispersant was obtained by mixing 500 ml of ion exchange water and 50 g of dispersant of the type listed in Tables 2 to 4 at 30 rpm using a mixer (T.K. HIVIS DISPER MIX Model HM-3D-5 manufactured by PRIMIX Corp.) To the aqueous solution of dispersant, 300 g of carrier cores of the type listed in Tables 2 to 4 were added. Next, dispersion liquid (I) of the carrier cores was prepared by stirring the carrier cores in the aqueous solution of dispersant at conditions of 30 rpm at room temperature for 30 minutes.

It should be noted that the following commercial products were used as the dispersant listed in Tables 2 to 4.

Sodium polyacrylate: JUYMER AC-103 manufactured by Toagosei Co., Ltd.

Partially saponified polyvinyl acetate: Gohsenol GM-14L manufactured by Nippon Synthetic Chemical (First Washing Process)

Using filter paper with 30 μm sieve openings, the carrier cores were filtered from dispersion liquid (I). Next, before the filtered carrier cores dried, the carrier cores were charged into 500 ml of ion exchange water again. Subsequently, dispersion liquid (II) containing carrier cores was prepared by mixing the ion exchange water containing the carrier cores at conditions of 30 rpm for 5 minutes using a mixer (T.K. HIVIS DISPER MIX Model HM-3D-5 manufactured by PRIMIX Corp.) to re-disperse the carrier cores in ion exchange water.

(Shell Layer Formation Process)

The raw material of the shell layer of the type and amount listed in Tables 2 to 4, 0.1 mg of a mixture of sodium 4-hydroxybenzenesulfonate and sodium 2-hydroxybenzenesulfonate, and 50 g of 0.05N-dilute hydrochloric acid were measured in a 100-ml beaker, and these were stirred using a magnetic stirrer. Next, the contents of the beaker were charged into the container of the mixer into which the above-mentioned dispersion liquid (II) of carrier cores was placed, and further mixed at conditions of 30 rpm for 5 minutes. Subsequently, the contents of the mixer were transferred to a 1-liter separable flask equipped with a thermometer and stirrer blade. The contents of the flask were heated from 35° C. to 80° C. at a rate of 5° C./15 min, while stirring using a stirrer having an AS ONE stirrer blade model R-1345 (manufactured by AS ONE Corp.) attached to an AS ONE Tornado motor 1-5472-04 (manufactured by AS ONE Corp.). Next, the shell layer was formed on the carrier core surface by stirring the contents of the flask at conditions of the same temperature and a revolution speed of 90 rpm for 1 hour. Subsequently, the contents of the flask were cooled to room temperature to obtain the dispersion liquid of the carrier.

The below commercial products were used as raw materials of the shell layers listed in Tables 2 to 4.

Methylolated urea: Mirbane Resin SU-400 manufactured by Showa Denko K.K.

Methylol melamine A: Nika Resin S-260 manufactured by Nippon Carbide Industries Co., Inc.

Methylol melamine B: Mirbane Resin SM-850 manufactured by Nippon Carbide Industries Co., Inc.

Methylol melamine C: Nika Resin S-176 manufactured by Nippon Carbide Industries Co., Inc.

Methylol melamine D: Mirbane Resin SM-850 manufactured by Showa Denko K.K.

Modified methylol melamine: Polyfix KM-7S manufactured by Showa Denko K.K.

(Second Washing Process)

Using a Buchner funnel, the wet cake of the carrier particles was filtered from the carrier dispersion liquid. The wet cake of carrier particles was dispersed in ion exchange water again to wash the carrier particles. Washing of the carrier particles using ion exchange water was repeated six times.

(Drying Process)

A slurry was prepared by dispersing the wet cake of carrier particles in a 50% by mass concentration ethanol aqueous solution. The carrier was obtained by supplying the obtained slurry to a continuous surface-modifying device (COATMIZER manufactured by Freund Corporation), and causing the carrier particles in the slurry to dry. The drying conditions using the COATMIZER were a heated air temperature of 45° C. and blower air flow of 2 $m^3$/min.

TABLE 2

| Example | 1 | 2 | 3 | 4 | 5 |
|---|---|---|---|---|---|
| Type of carrier core | A | B | A | C | A |
| Dispersant | | | | | |
| Type | Sodium poly-acrylate | Sodium poly-acrylate | Sodium poly-acrylate | Sodium poly-acrylate | Sodium poly-acrylate |
| Amount used [g] | 50 | 50 | 50 | 50 | 50 |
| Raw material of shell layer | | | | | |
| Type | Methylol melamine A | Methylol melamine A | Meth-ylolated urea | Methylol melamine A | Methylol melamine D |
| Amount used [g] | 1 | 1 | 1 | 1 | 1 |

TABLE 3

| Example | 6 | 7 | 8 | 9 |
|---|---|---|---|---|
| Type of carrier core | A | A | A | A |
| Dispersant | | | | |
| Type | Sodium poly-acrylate | Sodium poly-acrylate | Partially saponified polyvinyl acetate | Sodium poly-acrylate |
| Amount used [g] | 50 | 50 | 50 | 50 |
| Raw material of shell layer | | | | |
| Type | Modified methylol melamine | Methylol melamine C | Methylol melamine A | Methylol melamine A |
| Amount used [g] | 1 | 1 | 1 | 3 |

TABLE 4

| Comparative example | 1 | 2 |
|---|---|---|
| Type of carrier core | D | E |
| Dispersant | | |
| Type | Sodium poly-acrylate | Sodium poly-acrylate |
| Amount used [g] | 50 | 50 |
| Raw material of shell layer | | |
| Type | Methylol melamine A | Methylol melamine A |
| Amount used [g] | 1 | 1 |

Measurement

For the carrier particles contained in the carriers obtained in Examples 1 to 9, and Comparative Examples 1 and 2, the film thickness of the shell layer was measured according to the following method. The measurement results for the film thickness of the shell layer possessed by the carrier particles contained in the carriers of Examples 1 to 9 and Comparative Examples 1 and 2 are listed in Tables 5 to 7. Measurement Method of Film Thickness of Shell layer 1) A cured resin composition was obtained by irradiating UV rays onto a carrier-containing resin composition in which 1.0 g of magnetic material dispersion-based resin carrier or 0.5 g of ferrite carrier were dispersed in 1.0 g of photo-curing resin to cause the carrier-containing resin composition to cure.

2) The obtained cured resin composition was mounted to a grinding machine (Doctor-Lap ML-180SL manufactured by Maruto Instrument Co., Ltd.), and the surface of the cured resin composition was ground using #220, #800 and #2000 sand paper in this sequence to cause a cross-section of the carrier particles to be exposed at the surface of the cured resin composition.

3) Furthermore, the surface of the cured resin composition was mirror surface finished using a diamond slurry having a particle size of 3 μm, a diamond slurry having a particle size of 1 μm, and 0.1-μm alumina in this sequence.

4) The film thickness of the shell layer of carrier particles exposed at the ground surface of the cured resin composition was measured using a scanning probe microscope (Multimode 8 System manufactured by Bruker AXS, probe (spring constant: 40 N/m, material: silicon single crystal for all-purpose tapping), phase imaging) (SPM) on the ground surface of the cured resin composition subjected to mirror finish processing. The average value for the film thickness of the shell layer of at least 20 carrier particles detected by SPM was defined as the film thickness of the shell layer of the carrier particles.

Evaluation

Two-component developer was prepared using the carriers of Examples 1 to 9, Comparative Examples 1 and 2 and toner according to the following method. According to the following method, evaluation of the load acting on the stirring unit in the developing unit upon forming an image using the two-component developer containing carrier of Examples 1 to 9 and Comparative Examples 1 and 2, and evaluation of the durability of the carrier were performed using the obtained two-component developer. Using a multi-functional apparatus (TASKalfa5550 manufactured by Kyocera Document Solutions Inc.) as evaluation equipment, the two-component developer prepared in Preparation Example 3 was charged into the cyan color developing unit of the evaluation equipment, and toner was charged into the toner container for cyan of the evaluation equipment. The evaluation results for the carriers of Examples 1 to 9 and Comparative Examples 1 and 2 are listed in Tables 5 to 7.

Preparation Example 3

Preparation of Two-Component Developer

The carrier and 30% by mass cyan toner (toner for TASKalfa5550) relative to the mass of carrier were mixed for 30 minutes in a ball mill to prepare the two-component developer. It should be noted that 10% by mass of cyan toner relative to the mass of carrier was used for the carrier of Comparative Example 2.

Evaluation of Load on Stirring Unit During Developing

Using the evaluation equipment, after driving the developing motor which drives the developing unit of the evaluation machine for 10 minutes, the load torque of the developing motor which drives the stirring unit in the developing unit equipped to the evaluation machine was measured. The load of the stirring unit during developing was evaluated according to the following criteria.

OK: load torque of developing motor no more than 1.0 N·cm

NG: load torque of developing motor exceeding 1.0 N·cm

Evaluation of Durability

Using the evaluation machine, durability tests to form an image on 100,000 sheets of recording media was performed at 20° C. with 60% RH and a coverage rate of 5%. The charge amount of toner after the durability test, and after the durability test using a sample image for evaluation formed on recording media as an evaluation image, the image density of the evaluation image and the transcription efficiency during the durability test were evaluated.

(Toner Charge Amount Evaluation)

The charge amount of the toner in the two-component developer after the durability test was measured under conditions of 20° C. at 60% RH. The charge amount was measured using a QM meter (Model 210HS-1 manufactured by TREK Co.). The charge amount was evaluated according to the following criteria.

OK: charge amount of at least 12.0 μC/g

NG: charge amount less than 12.0 μC/g (Image Density Evaluation)

After the durability test, the image density of the evaluation image formed on the recording media was measured using a SpectroEye (manufactured by Sakata Inx Eng. Co., Ltd.). The image density was evaluated according to the following criteria.

OK: image density of at least 1.2

NG: image density less than 1.2

(Transcription Efficiency Evaluation)

After the durability test, toner having fallen inside of the evaluation machine was collected and the mass thereof was measured. The transcription efficiency was obtained according to the following formula from the mass of toner consumed during the durability test and the mass of collected toner. Then, the obtained transcription efficiency was evaluated according to the following criteria.

$$\text{Transcription efficiency (\%)}=((\text{consumed toner amount})-(\text{collected toner amount}))/(\text{consumed toner amount}))\times 100$$

OK: transcription efficiency of at least 90%

NG: transcription efficiency less than 90%

TABLE 5

| Example | 1 | 2 | 3 | 4 | 5 |
|---|---|---|---|---|---|
| Carrie core Particle | | | | | |
| Type of binder resin | Polyester resin | Polyester resin | Polyester resin | Copolymer of styrene, acrylic acid and butyl acrylate | Polyester resin |
| Acid value of binder resin [mgKOH/g] | 20 | 12 | 20 | 23 | 20 |
| Thickness of shell layer [nm] | 52 | 41 | 32 | 56 | 60 |

TABLE 5-continued

| Example | 1 | 2 | 3 | 4 | 5 |
|---|---|---|---|---|---|
| Lord during developing | | | | | |
| Load torque of developing motor [N · cm] | 0.6 | 0.8 | 0.7 | 0.6 | 0.6 |
| Evaluation | OK | OK | OK | OK | OK |
| Durability | | | | | |
| Charge amount [μC/g] | 18 | 13 | 17 | 20 | 20 |
| Evaluation | OK | OK | OK | OK | OK |
| Image density | 1.25 | 1.22 | 1.21 | 1.22 | 1.22 |
| Evaluation | OK | OK | OK | OK | OK |
| Transcription efficiency [%] | 95 | 90 | 92 | 91 | 90 |
| Evaluation | OK | OK | OK | OK | OK |

TABLE 6

| Example | 6 | 7 | 8 | 9 |
|---|---|---|---|---|
| Carrie core particle | | | | |
| Type of binder resin | Polyester resin | Polyester resin | Polyester resin | Polyester resin |
| Acid value of binder resin [mgKOH/g] | 20 | 20 | 20 | 20 |
| Thickness of shell layer [nm] | 39 | 40 | 29 | 231 |
| Lord during developing | | | | |
| Load torque of developing motor [N · cm] | 0.8 | 0.7 | 0.7 | 0.6 |
| Evaluation | OK | OK | OK | OK |
| Durability | | | | |
| Charge amount [μC/g] | 19 | 16 | 17 | 25 |
| Evaluation | OK | OK | OK | OK |
| Image density | 1.21 | 1.23 | 1.22 | 1.20 |
| Evaluation | OK | OK | OK | OK |
| Transcription efficiency [%] | 91 | 90 | 91 | 91 |
| Evaluation | OK | OK | OK | OK |

TABLE 7

| Comparative example | 1 | 2 |
|---|---|---|
| Carrie core particle | | |
| Type of binder resin | Polyester resin | — |
| Acid value of binder resin [mgKOH/g] | 8 | — |
| Thickness of shell layer [nm] | 34 | 62 |
| Lord during developing | | |
| Load torque of developing motor [N · cm] | 0.7 | 1.9 |
| Evaluation | OK | NG |
| Durability | | |
| Charge amount [μC/g] | 11 | 22 |
| Evaluation | NG | OK |
| Image density | 1.1 | 1.2 |
| Evaluation | NG | OK |
| Transcription efficiency [%] | 75 | 88 |
| Evaluation | NG | NG |

From Examples 1 to 9, it is found that, for a carrier for electrostatic latent image developing composed of carrier core containing binder resin and magnetic material particles and a shell layer that covers the carrier core, when using a binder resin having an acid value of at least a predetermined value and containing a resin having carboxyl groups and using a resin selected from melamine resin and urea resin as the material of the shell layer, the load acting on the stirring unit inside of the developing unit equipped to an image formation apparatus can be reduced; and in the case of using the toner and carrier as a two-component developer, a carrier is obtained that can suppress the occurrence of toner scatter caused by a decline in the ability of the carrier to charge toner and the generation of oppositely charged toner particles, upon forming images over an extended time period.

From Comparative Example 1, it is found that, in the case of using a two-component developer containing toner and the carrier prepared using carrier core containing a binder resin for which the acid value is less than 10 mg KOH/g, it is difficult for the toner particles to be favorably charged, and the occurrence of toner scatter caused by the generation of oppositely charged toner particles tends to occur, upon forming images of an extended time period. The reason thereof is assumed to be peeling off of the shell layer occurring upon forming images over an extended time period with the two-component developer containing the carrier of Comparative Example 1, and accompanying this, dropping out of the magnetic material particles from the carrier core occurring.

From Comparative Example 2, it is found that, in the case of using a two-component developer containing ferrite particle as the carrier core, a great load acts on the stirring unit in the developing unit equipped to the image formation apparatus, and toner scatter caused by the generation of oppositely charged toner particles occurs.

The invention claimed is:

1. A carrier for electrostatic latent image developing comprising:

carrier cores containing at least a binder resin and magnetic material particles; and a shell layer that covers the carrier core, wherein the binder resin contains a resin having a carboxyl group, wherein a glass transition temperature of the binder resin is 60° C. or more and 80° C. or less, wherein the acid value of the binder resin is at least 10 mg KOH/g, and wherein the shell layer comprises a resin selected from the group consisting of melamine resin and urea resin.

2. A carrier for electrostatic latent image developing according to claim 1, wherein the binder resin contains polyester resin.

3. A carrier for electrostatic latent image developing according to claim 1, wherein the magnetic material particles are magnetite particles.

4. A two-component developer comprising: toner; and the carrier for electrostatic latent image developing according to claim 1.

* * * * *